US007337991B2

(12) United States Patent
Simoens

(10) Patent No.: US 7,337,991 B2
(45) Date of Patent: Mar. 4, 2008

(54) ACCESSORY FOR AIR BLAST AND DEVICE EQUIPPED WITH ACCESSORY

(76) Inventor: Herve Simoens, 40, avenue Foch, F-59700 Marcq-en-Baroeul (FR)

( * ) Notice: Subject to any disclaimer, the term of this patent is extended or adjusted under 35 U.S.C. 154(b) by 194 days.

(21) Appl. No.: 10/540,982

(22) PCT Filed: Jan. 15, 2004

(86) PCT No.: PCT/FR2004/000069

§ 371 (c)(1),
(2), (4) Date: Jun. 27, 2005

(87) PCT Pub. No.: WO2004/070213

PCT Pub. Date: Aug. 19, 2004

(65) Prior Publication Data

US 2006/0121839 A1 Jun. 8, 2006

(30) Foreign Application Priority Data

Jan. 16, 2003 (FR) ..... 03 00463

(51) Int. Cl.
*B05B 1/04* (2006.01)
*B05B 1/00* (2006.01)

(52) U.S. Cl. ..... 239/594; 239/589; 239/597; 239/595

(58) Field of Classification Search ..... 239/589–601, 239/DIG. 21
See application file for complete search history.

(56) References Cited

U.S. PATENT DOCUMENTS 5,050,805 A * 9/1991 Lloyd et al. ..... 239/424
6,830,230 B2 * 12/2004 Simoens ..... 251/30.03
6,845,928 B1 * 1/2005 Felgen ..... 239/589
6,962,317 B2 * 11/2005 Simoens ..... 251/30.04

* cited by examiner

*Primary Examiner*—Kevin Shaver
*Assistant Examiner*—James S. Hogan
(74) *Attorney, Agent, or Firm*—Miles & Stockbridge P.C.; Edward J. Kondracki

(57) ABSTRACT

The invention relates to an accessory adapted to be mounted on the end of an outlet conduit (4) of an air blast device (1). The accessory is in the form of a tube having an inlet, an outlet and a central passage therethrough, the axial passage or tube being mounted coaxially to the axis of the outlet conduit. The tube has a cross-sectional area that first decreases in the direction (F) in which the air is discharged from the air blast device and a cross-sectional area that then increases in the direction F, thus forming a convergent segment (A) followed by a divergent segment (B). The air blast device is of the type having an evacuation control valve disposed between its inlet and outlet for controlling air flow contained in a chamber or reservoir.

20 Claims, 3 Drawing Sheets

ACCESSORY FOR AIR BLAST AND DEVICE EQUIPPED WITH ACCESSORY

CROSS REFERENCE TO RELATED APPLICATION

This application is a national stage application of PCT/fr2004/000069, filed Jan. 15, 2004.

BACKGROUND OF THE INVENTION

1. Field of the Invention

The invention relates to an accessory for an air blast device.

It also relates to the air blast device equipped with this accessory.

2. Description of Related Art

For example, in order to eliminate areas of material build-up in cement kilns, it is known to use blast devices, also known as air-cannons.

The principle of these devices is to release a quantity of air suddenly so as to create a sort of blast which will remove the material build-up that accumulates during the manufacturing process.

The advantage of these devices consists in the fact that they can operate automatically and can be used in places that are not very accessible.

They also avoid the need for human intervention, which is a guarantee of safety.

Of course, these air cannons are also used in other fields.

Conventionally, such a device comprises a body housing a piston constituting a valve disposed between a tank and an outlet conduit. U.S. Pat. No. 6,830,230 is an exemplary embodiment of such a device and the subject matter thereof is hereby incorporated by reference in its entirety.

When the valve moves out of its seat, the air trapped in the tank is suddenly discharged through the outlet conduit.

This outlet conduit may be longer or shorter, but generally, to avoid production problems and/or wear, this outlet conduit comprises a first part that is integral with the body of the blast device and a second part or accessory that is intended to extend the first part.

Since the blast device is located outside the kiln, this second part makes it possible to pass through the wall and open a longer or shorter distance away from the internal surface of said wall.

Conventionally, this second part or accessory, also called a nozzle, has a constant cross-sectional area along its longitudinal axis, though often the geometry of this cross-section is variable.

In fact, the geometric shape of the inlet of this accessory is circular, while the geometry of the outlet may be flattened in order to fit into the space of one or more refractory bricks.

The efficiency of these devices depends on the volume of the tank, the pressure in the latter, and the opening speed of the valve.

It is very important to deliver a quantity of energy in a short instant.

SUMMARY OF THE INVENTION

The effects produced by a blast are not comparable to the effect of a gas under pressure that feeds a nozzle continuously (DE-A-4128165 or DE-A-2035378).

In certain places, the volume of the tank is limited because of its size, and often the air feed pressure of these tanks is limited.

It is then necessary to increase the number of these devices, assuming there is enough space, which is not always the case.

The object of the invention is to provide a solution that makes it possible to improve the efficiency of these air blast devices.

To this end, the subject of the invention is an accessory that is intended to be mounted on the end of an outlet conduit of an air blast device, this accessory being in the form of a tube mounted coaxially to the axis of the outlet conduit, this accessory being characterized in that the cross-sectional area of this tube decreases in the direction in which the air is discharged, then increases, thus forming a convergent segment followed by a divergent segment.

The other subject of the invention is the air blast device equipped with the accessory according to the invention.

BRIEF DESCRIPTION OF THE DRAWINGS

The invention will be clearly understood with the help of the following description given as a nonlimiting example in reference to the attached drawing, which schematically represents.

DESCRIPTION OF THE PREFERRED EMBODIMENTS

Figure 1:
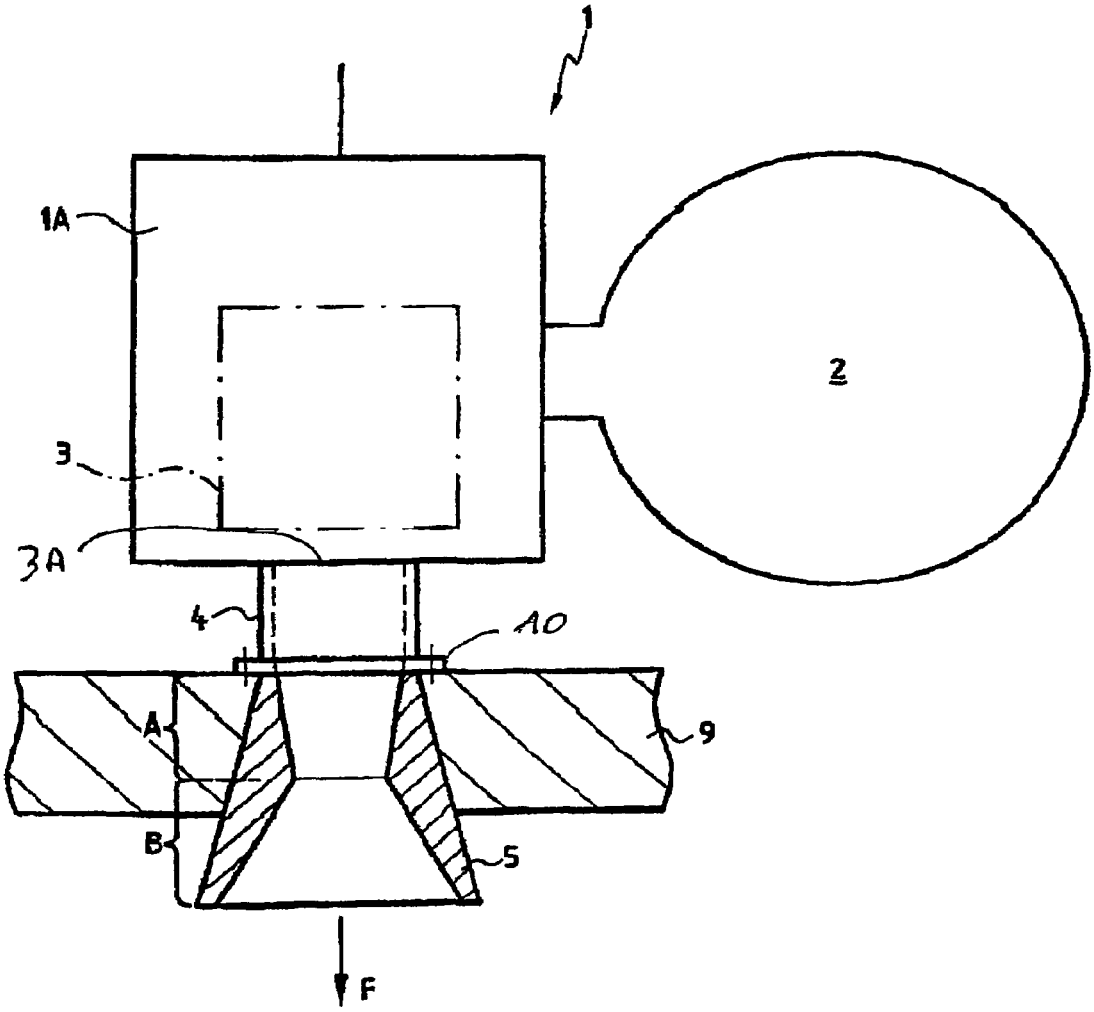
FIG. 1: an air cannon with its accessory attached.

Referring to the drawing, we see a device 1 for suddenly discharging air contained in a tank 2.

The blast device is mounted, for example, on a wall 9.

This blast device comprises a body 1A or housing, containing a valve 3 and its seat 3A, which valve, when it is moved out of its seat, allows the air contained in the tank to pass through an outlet conduit 4.

This short outlet conduit is extended by an accessory 5 in the form of a tube mounted coaxially to the axis of the outlet conduit 4.

This accessory is attached to the end of the outlet conduit by a fastening means 10 such as a flange.

This accessory 5 is generally set inside a wall 9 that it passes through.

These air blast devices operate as follows:

First, the air coming from the feed proceeds to accumulate in the tank, which fills up.

When the tank has reached the required fill value, the feed of this tank is cut off, and the return motion of the valve is actuated, moving it out of its seat.

The air contained in the tank is suddenly discharged, releasing a substantial amount of energy in a brief instant, thus causing a blast, i.e., an impact force that can be measured by means of a force sensor.

According to the invention, the cross-sectional area of this tube decreases in the direction F in which the air is discharged, then increases, thus forming a convergent segment A followed by a divergent segment B.

It is clear that this increases efficiency.

In a first embodiment, the area E of the inlet of the accessory is equal to the area S of the outlet.

In a second embodiment, the area S of the outlet of the accessory is greater than this inlet area E.

Figure 2:
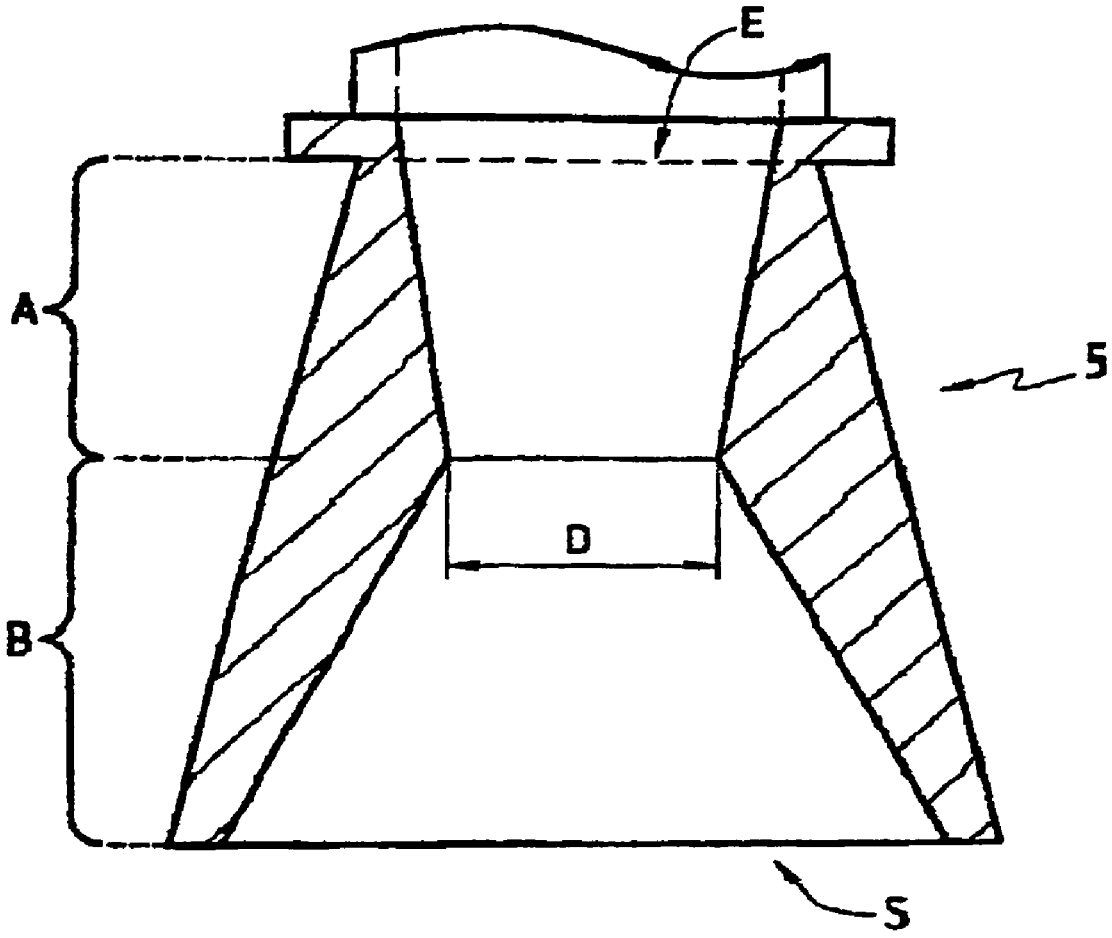
FIG. 2: the accessory seen in axial cross-section.
Figure 3:
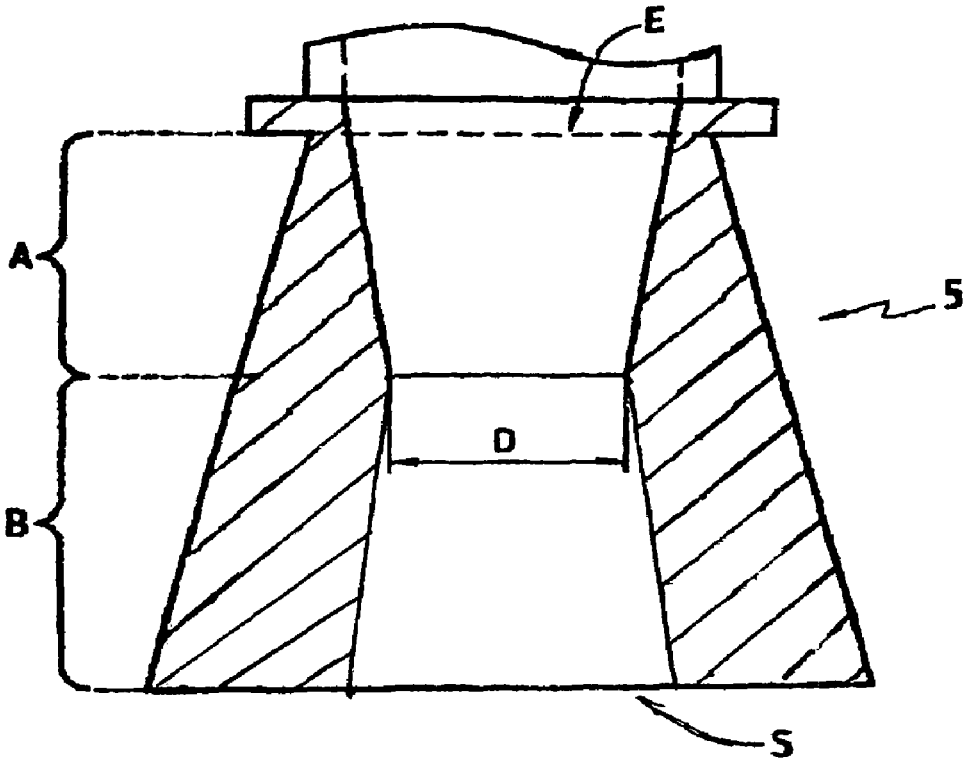
FIG. 3: a second embodiment of the accessory seen in axial cross-section.

The ratio between the cross-section D measured at the cross-sectional level within the tube having the smallest area and the inlet cross-section E as shown in FIG. 2 is greater than or equal to 1/5, but preferably greater than 1/3.

The ratio between the cross-section D measured at the cross-sectional level within the tube having the smallest area and the outlet cross-section S as shown in FIG. 2 is greater than or equal to 1/5.

The distance between the position of the aforementioned cross-section D and the seat against which the valve rests is a maximum of one meter for a pressure of up to twelve bar.

Tests were performed with an air blast device having an inlet diameter E of 150 mm and with a 100-liter tank.

The force sensor was placed at the end of a tube that is 500 mm long.

It is clear that the results are better when the ratio D/E is between 0.6 and 0.8.

An increase in the impact force on the order of 50% is obtained.

This system minimizes the effects of vortexes, which reduce efficiency.

What is claimed is:

1. An accessory adapted to be mounted on the end of an outlet conduit (4) of an air blast device (1), said accessory comprising a tube having an axial passage, said tube adapted to be mounted coaxially with an axis of the outlet conduit, said tube having a cross-sectional area along its axis that decreases in a direction (F) in which a predetermined finite amount of air is adapted to suddenly be discharged from the outlet conduit of the device (1), said tube then increasing in cross-sectional area along its axis—in the direction (F), thus forming a convergent segment (A) having an inlet cross-section area (E) and a throat area of smallest cross section (D) followed by a single-angled divergent segment (B) having an outlet cross-section area (S) adapted to produce an instantaneous impact force external to the outlet cross-section (S) from the sudden discharge of the predetermined finite amount air.

2. An accessory according to claim 1, characterized in that the cross-section area (E) of the inlet of the accessory is equal to the cross-section area (S) of the outlet.

3. An accessory according to claim 1, characterized in that the outlet cross-section area (S) of the accessory is greater than the inlet cross-section area (E).

4. An accessory according to claim 1, characterized in that the ratio between the cross-section area (D) and the inlet cross-section area (E) is at least 1/5.

5. An accessory according to claim 1, characterized in that the ratio between the cross-section area (D) and the inlet cross-section area (E) is at least 1/3.

6. An accessory according to claim 1, characterized in that the ratio between the cross-section area (D) and the inlet cross-section area (E) is between 0.6 and 0.8.

7. An accessory according to claim 1, characterized in that the ratio between the cross-section area (D) and the outlet cross-section area (S) is at least 1/5.

8. An accessory according to claim 1, characterized in that the distance between the position of the cross-section area (D) and the seat against which a valve of the device (1) rests is a maximum of one meter for a pressure of up to twelve bar.

9. An air blast device comprising an inlet and an outlet, a control valve disposed between the inlet and the outlet for controlling air flow from the outlet, an accessory having a first end and a second end, the first end of said accessory being connected to the outlet of the air blast device, the accessory being in the form of a tube having a first segment of cross-sectional area gradually decreasing in size in a direction in which air is discharged from the air blast device and terminating at a point that provides a cross-section area that is smallest across the tube and a second segment of cross-sectional area extending from said point and gradually increasing in size in the direction in which air is discharged from said outlet.

10. An air blast device as set forth in claim 9, characterized in that said accessory has an inlet (E) and outlet (S) of equal cross-section areas (S).

11. An air blast device as set forth in claim 9, wherein the accessory has an outlet cross-section area (S) greater than an inlet cross-section area (E).

12. An air blast device as set forth in claim 9, characterized in that said tube has cross-section area (D) measured at a point where the cross-sectional area as smallest and a cross-section (E) at the inlet, the cross-section areas (D) and (E) having a ratio of at least 1/5.

13. An air blast device as set forth in claim 9, characterized in that said tube has a cross-section area (D) measured at a point where the cross-sectional area is smallest and a cross-section (E) at the inlet the cross-section areas (D) and (E) having a ratio of at least 1/3.

14. An air blast device as set forth in claim 9, characterized in that said tube has a cross-section area (D) measured at a point when cross-sectional area is smallest and a cross-section area (E) at the inlet the cross-section areas (D) and (E) having a ratio between 0.6 and 0.8.

15. An air blast device as set forth in claim 9, characterized in that said tube has a cross-section area (D) measured at a point where the cross-sectional area is smallest and a cross-section area (S) at the outlet, ratio of areas (D) to (E) being at least 1/5.

16. An air blast device as set forth in claim 9, characterized in that the distance between a position corresponding to a smallest cross-section area (D) of the tube and a seat against which a valve of the air blast device rests is a maximum of one meter for a pressure of up to twelve bar.

17. An accessory adapted to be mounted on the end of an outlet conduit (4) of an air blast device (1), and comprising an inlet (E), an outlet (S) and an axial passage therethrough, said accessory when mounted having its axial passage coaxial with an axis of the outlet conduit, said axial passage having a cross-sectional area that decreases for a fixed distance in direction (F) in which the air is discharged, then increases for a fixed distance at a single angle in the direction (F) in which air is discharged, thus forming a convergent segment (A) followed by a constant angle divergent segment (B), said axial passage being adapted to produce an instantaneous impact force external to the outlet (S) from a sudden discharge of a predetermined finite amount air from the air blast device (1).

18. An accessory according to claim 17, characterized in that the ratio of the areas of the decreasing cross-section of the axial passage at the point of minimum cross-section area (D) and the cross-section area of the inlet of the axial passage is at least 1/5.

19. An accessory according to claim 17, characterized in that the ratio of the areas of the decreasing cross-section of the axial passage at the point of minimum cross section area (D) and the cross-section area of the inlet of the axial passage is at least 1/5.

20. An accessory according to claim 17, characterized in that the inlet (E) and the outlet (S) have cross-sectional areas that have at least a 1/1 ration and a common cross-sectional area of minimum cross-section area (D), the ratio of the common cross-section area to each of the cross-section areas of the inlet being at least 1/3.

* * * * *